US006405618B1

(12) United States Patent
Sorensen et al.

(10) Patent No.: US 6,405,618 B1
(45) Date of Patent: Jun. 18, 2002

(54) SOCKET WRENCH WITH HANDLE-HOUSED DRIVE SOCKETS

(75) Inventors: Joseph A. Sorensen; Charles Poremba, both of Bozeman, MT (US)

(73) Assignee: WMH Tool Group, Inc., Palatine, IL (US)

( * ) Notice: Subject to any disclaimer, the term of this patent is extended or adjusted under 35 U.S.C. 154(b) by 0 days.

(21) Appl. No.: 09/707,266

(22) Filed: Nov. 6, 2000

(51) Int. Cl.[7] ..... B25B 13/46
(52) U.S. Cl. ..... 81/63.1; 81/177.4; 81/490
(58) Field of Search ..... 81/60–63.2, 177.4, 81/490

(56) References Cited

U.S. PATENT DOCUMENTS

| | | | | |
|---|---|---|---|---|
| 1,596,351 A | | 2/1926 | Smith | |
| 4,043,230 A | * | 8/1977 | Scrivens | 81/177.4 |
| 4,253,356 A | * | 3/1981 | Martinmass | 81/177.4 |
| 4,302,990 A | | 12/1981 | Chrichton et al. | |
| 4,352,307 A | | 10/1982 | Martinmass | |
| RE31,140 E | | 2/1983 | Martinmass | |
| 4,627,315 A | | 12/1986 | Lin | |
| 4,727,782 A | | 3/1988 | Yang | |
| 5,228,570 A | * | 7/1993 | Robinson | 81/177.4 X |
| 5,320,004 A | | 6/1994 | Hsiao | |
| 5,421,225 A | * | 6/1995 | Chen | 81/177.4 X |

* cited by examiner

*Primary Examiner*—James G. Smith
(74) *Attorney, Agent, or Firm*—Fitch, Even, Tabin & Flannery

(57) ABSTRACT

Disclosed is a ratchet wrench having a drive head and a handle, the latter defining an elongate body. The body of the wrench is formed with a series of through cavities which are sized in steps for releasibly holding a series of correspondingly sized sockets. The sockets are retained in place frictionally by means of elastomeric inserts carried by and positioned to project inwardly of exposed annular side walls which define the cavities. Conveniently, the stored sockets may be forcibly expelled from the cavities in either of two opposed axial directions. For ready visual identification, markings are provided on the body of the wrench indicating the specific size of each socket-receiving cavity. The described features of the ratchet wrench also enable one quickly to verify the socket size, and allow socket placement over a fastener without requiring that the socket itself be first removed from the tool handle.

17 Claims, 1 Drawing Sheet

SOCKET WRENCH WITH HANDLE-HOUSED DRIVE SOCKETS

FIELD AND BACKGROUND OF THE INVENTION

The present invention relates, generally, to a ratchet wrench and drive socket assembly. More particularly, the invention is directed to a ratchet wrench with a size-graduated series of handle-housed drive sockets conveniently arranged, readily identifiable, easily removable for use as required, and relocatable in the wrench handle for storage and for later withdrawal and reuse, as required.

Wrenches with handle-carried tool elements are known in the art. Among these are ratchet wrenches formed with handle cavities for accommodating stored drive sockets. In some such prior art tools, access digitally to the stored sockets is restricted and effectively impaired. Removal of any particular, selectable socket for use is difficult or awkward. In others of the prior art devices, the particular sizes of the stored sockets are not marked, or adequately displayed so as to be readily identifiable. One must guess. One must resort to time-consuming "trial and error" steps, as he picks and chooses, to find, but only after delay, the correct socket for the task at hand. In yet others of the pror art ratchet drive wrenches which carry a series of variously-sized drive sockets, it is not feasible, in any specific situation, to determine, without first physically removing a given socket from its stored position in the handle of the wrench, whether that given, particular drive socket is, in fact, the correct size required.

It is a principal aim of the present invention to provide a drive-socket-carrying ratchet wrench which is simple in structure, effectve and convenient in use, and which obviates many of the shortcomings of earlier devices.

SUMMARY OF THE INVENTION

The present invention provides improvements in a ratchet wrench of the type which includes an elongate handle and a reversible, rotatable drive adapted operationally to engage selectively any and each of a plurality of drive sockets to be coupled therewith for functional use with the wrench.

It is an important feature of the present invention that the handle of the ratchet wrench is formed with a plurality of distinct and discrete cavities of different sizes for receiving therein in secured yet removable engagement therewithin each of a series of selectable differently sized drive sockets for operational use with the socket wrench.

A related feature of the invention is that each of the cavities in the handle of the ratchet wrench is generally cylindrical and has a principal axis normal to a lineal expanse of the body of the wrench.

A very important feature of the invention is that there are provided holding elements within the cavities for engaging and releasably retaining the drive sockets in the handle of the wrench.

It is a related feature of the invention that, in a preferred embodiment thereof, the socket-holding elements contact and engage the sockets frictionally. In a specific embodiment of the invention, the physical material which comes into direct contact with the sockets when the latter are in place in their respective cavities is of a resilient, elastomeric composition. In a preferred embodiment of the invention the socket-securing elements take the form of elastomeric fingers seated in grooves formed in the generally cylindrical walls which bound the cavities in which the various sockets are housed.

It is an important feature of the socket-holding handle of the wrench of the invention that the socket carrying cavities extend entirely through the body of the handle, thus allowing socket removal, axially, in either of opposed directions.

A valuable time-conserving feature of the invention is the provision of readily and clearly perceptible visual indicia displayed on the handle of the tool for identifying each particular socket to be housed in each specific corresponding cavity in the tool handle.

An important capability derived from the particular mode of disposition of the drive sockets in the handle of the tool of the invention is that the socket size elected can be verified by allowing trial socket placement over a given fastener—all without removal of the socket from the tool handle.

In a preferred embodiment of the invention the body of the ratchet drive wrench comprises a molded body of plastics composition sandwiched between upper and lower metal plates.

Other and further objects, features and advantages of the invention will become apparent from the following detailed description considered in conjunction with the drawings.

DETAILED DESCRIPTION OF ILLUSTRATED EMBODIMENTS

Figures 1, 2, 3, 4:
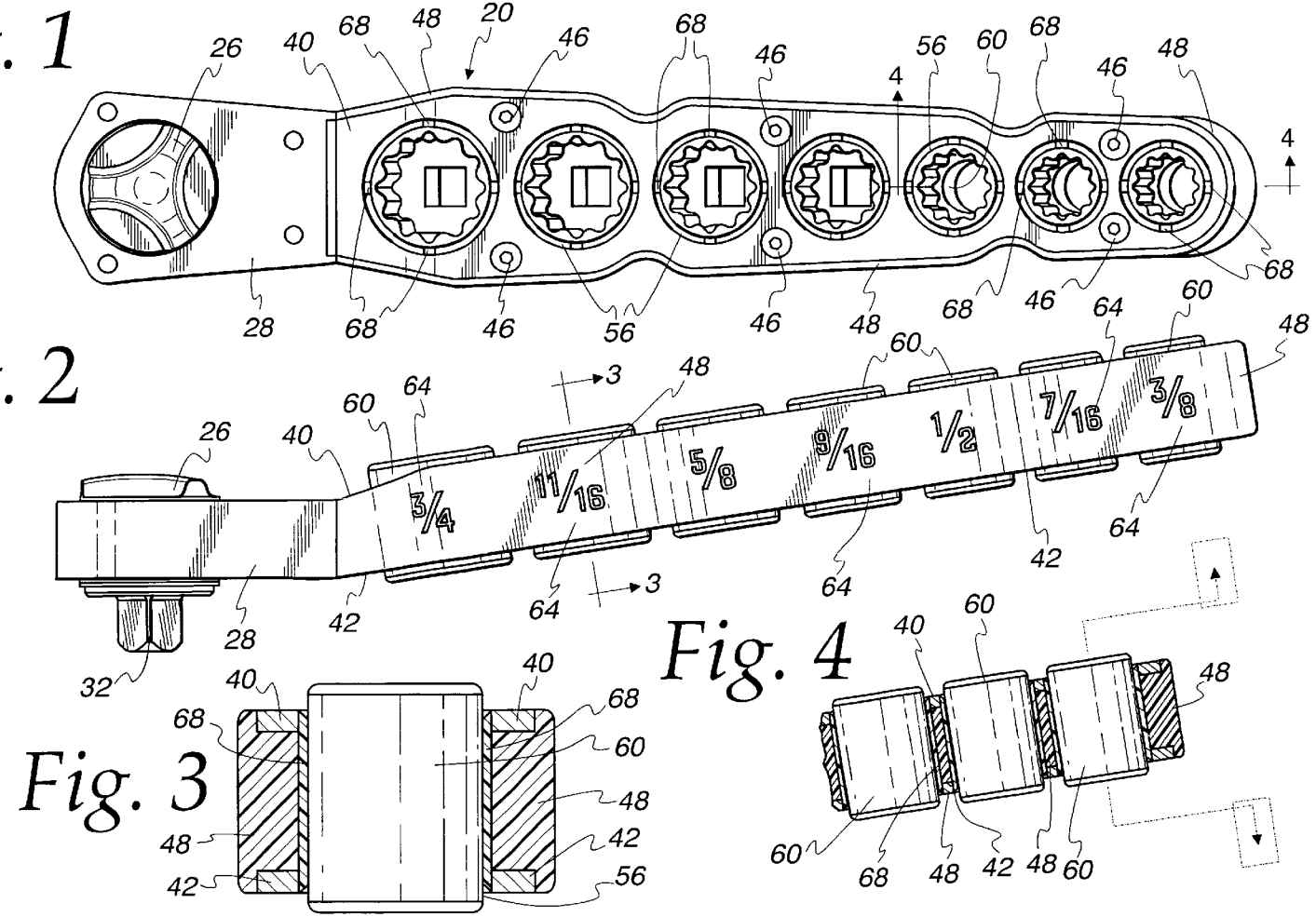
FIG. 1 is a top view of a socket wrench with handle-housed drive sockets, in accordance with the present invention.
FIG. 2 is a side elevational view of the socket wrench and drive sockets of FIG. 1.
FIG. 3 is a cross-sectional view taken on the lines 3—3 of FIG. 2.
FIG. 4 is a cross-sectional view taken on the lines 4—4 of FIG. 1, and indicating that the wrench-held sockets may be conveniently pushed out of the wrench handle in either of opposed co-axial directions.

In accordance with the present invention, the aims and objects are achieved by providing, in the elongate handle of a ratchet wrench, a series of through cavities sized in steps for releasably holding a series of correspondingly sized drive sockets frictionally secured in place. The sockets are removable in either of opposed axial directions and the body of the wrench is provided with visual identification markings indicating the size of each socket-receiving cavity. Additionally, the manner of securing the sockets permits one simply and quickly to identify and verify the socket size, and also allows socket placement over a fastener to confirm that the socket is in fact the correct one for the operation contemplated—all without requiring that the socket itself be first removed from the tool handle.

Referring now to the drawings, for purposes of disclosure and not in any limiting sense, a preferred embodiment of the invention is shown in FIGS. 1 and 2 as comprising a ratchet wrench 20 having an elongate, slightly arcuate handle 24 (FIG. 1) and a reversible 26 drive head 28 carrying a socket-engaging drive stud 32. In a preferred embodiment of the invention, and as shown in FIG. 2, the handle 24 of the wrench 20 is angled 34 slightly upwardly with respect to the drive head 28 of the wrench 20 (FIG. 2), to ensure hand clearance when one puts the wrench 20 to its intended use.

The elongate handle or body 24 of the wrench 20 includes a 3-layer structure constituting vertically-spaced, parallel, upper and lower steel plates, panels or sheets 40 and 42 secured to one another by fasteners 46. Sandwiched by and confined between the bounding steel plates 40 and 42 is a body or filler layer 48 of a plastics or elastomeric composition.

The handle 24 of the wrench 20 is formed, as a lineal array, with a series of through cavities 56 of different, stepped, diameter sizes for accommodating drive sockets 60 of different sizes, for operational use with the ratchet wrench 20. In the specific embodiment of the invention illustrated, the socket sizes contemplated embrace a range from ⅜ inch to ¾ inch, in increments of 1/16 inch. Thus, the seven cavities accommodate 7 different sizes of drive sockets. As depicted, the handle 24 is marked, along a lineal expanse of the sidewall 48 thereof, at each socket location, with numerical indicia 64 identifying the size of each drive socket 60 to be housed or stored in each particular cavity 56 (FIG. 2).

The stored drive sockets 60 are frictionally secured or held in each respective cavity 56, until pushed out, as needed.. In the illustrated embodiment of the invention, the bounding cylindrical wall of each cavity 56 is formed with grooves for accommodating and securing therewithin bead-like fingers 68 of rubber or of an elastomeric composition. A portion of the finger 68 projects to extend radially inwardly to invade the cavity 56 to engage and frictionally (yet releasably) to hold each given drive socket 60 in place until forcibly pushed out, from either end of the cavity 56 of the handle 24. The physical structure described permits one easily and simply to re-insert each drive socket in its respective cavity, for positive, secured retention until needed again.

What is claimed is:

1. In a ratchet wrench including an elongate handle and a reversible, rotatable drive adapted operationally to engage selectively any and each of a plurality of drive sockets to be coupled therewith for functional use with said wrench, the improvement wherein said handle comprises a body formed with a plurality of distinct and discrete cavities of different sizes for receiving therein in secured yet removable engagement therewith each of a series of selectable differently-sized drive sockets for operational use with said socket wrench, each of said cavities being generally cylindrical and having a principal axis normal to a lineal expanse of said body of said wrench, and holding means within said cavities for engaging and for retaining said drive sockets in said cavities, said holding means being operational to facilitate ready removal of said drive sockets in either of opposed axial directions of said sockets for use with said wrench as required, and to permit prompt replacement of said drive socket in said cavities for storage and for ready retrieval for re-use.

2. The improvement of claim 1, wherein said holding means for engaging said drive sockets comprise means within said cavities for frictionally engaging encircling bounding walls of said drive sockets extending into said cavities in said handle of said ratchet wrench.

3. The improvement of claim 2, wherein said means for frictionally engaging said walls of said drive sockets comprise finger means disposed with outer lineal zonal edges thereof extending radially inwardly of said walls defining said cavities formed in said handle for bearing resiliently against bounding cylindrical side walls of said drive sockets seated in said cavities, and for deterring inadvertent dislodgment of said drive sockets axially from said cavities in said body of said handle of said wrench.

4. The improvement of claim 3, wherein said finger means extend along a lineal expanse of said walls defining said cavities.

5. The improvement of claim 1, wherein the cavities extend through said body of said handle, transversely thereof.

6. The improvement of claim 1, further comprising visual indicia means carried on said body of said handle for identifying the size of each socket to be housed therein.

7. The improvement of claim 1, wherein said body of said handle includes a molded plastics sector interposed between a pair of sandwiching metal plates.

8. The improvement of claim 1, wherein, without removal of a particular socket from its place in said body of said socket wrench, each said socket can be positioned, in turn, over a given fastener to determine the correct socket to be used in a given instance.

9. A ratchet wrench having at least one handle-housed drive socket, the ratchet wrench comprising:

a drive mechanism and an elongate handle having first and second sides, wherein the elongate handle extends from the drive mechanism and defines at least one through opening located therein passing from the first side to the second side; and a surface at the through opening capable of engaging a drive socket to maintain the drive socket while not in use, and wherein the surface and the opening allow for the drive sockets to be removed from one of either the first or second sides of the handle.

10. A ratchet wrench according to claim 9, wherein the handle is angled with respect to the drive mechanism to ensure hand clearance when the ratchet wrench is put to its intended use.

11. A ratchet wrench according to claim 9, wherein the handle allows for trial placement of the drive sockets prior to removing the drive sockets from the handle for use with the drive mechanism.

12. A ratchet wrench according to claim 9, wherein the handle comprises a molded body of plastic sandwiched between first and second plates of metal composition.

13. A ratchet wrench capable of being used with a plurality of drive sockets to turn a fastener, the wrench comprising:

an elongated handle with an elongated axis, the handle defining a plurality of cavities, each cavity having a longitudinal axis perpendicular to the elongated axis of the handle and each being sized to hold a socket with a friction engagement that maintains the socket against unintentional removal and permits removal from either side of the handle along the cavity axis; and a ratchet drive at one end of the elongated handle, the drive being adapted to selectively engage any and each of a plurality of drive sockets to tighten a fastener.

14. A ratchet wrench according to claim 13, wherein each cavity is defined by an inner surface that is capable of engaging a drive socket with a friction engagement, and the inner surface has a friction enhancing texture to aid in maintaining the socket against unintentional removal.

15. A ratchet wrench according to claim 14, wherein the texture is provided by an elastomeric composition on the inner surface of each cavity.

16. A ratchet wrench according to claim 15, wherein the elastomeric composition at the inner surface of each cavity defines grooves to functionally aid in maintaining the socket against unintentional removal.

17. A ratchet wrench according to claim 14, wherein the inner surface has grooves for accommodating bead-like fingers of an elastomeric composition.

* * * * *

UNITED STATES PATENT AND TRADEMARK OFFICE

CERTIFICATE OF CORRECTION

PATENT NO. : 6,405,618 B1
DATED : June 18, 2002
INVENTOR(S) : Sorensen et al.

It is certified that error appears in the above-identified patent and that said Letters Patent is hereby corrected as shown below:

Column 3,
Lines 65-67, should read as follows:

4. The improvement of claim 3, wherein said finger means extend along a lineal expanse of said cavities in said walls defining said cavities.

Signed and Sealed this

Seventh Day of January, 2003

JAMES E. ROGAN
*Director of the United States Patent and Trademark Office*